United States Patent [19]

Emsperger et al.

[11] Patent Number: 4,766,851

[45] Date of Patent: Aug. 30, 1988

[54] COMBUSTION CHAMBER FOR A FLUIDIZED-BED FURNACE

[75] Inventors: Werner Emsperger, Erlangen; Hermann Brückner; Georg Lösel, both of Uttenreuth; Rudolf Pieper, Erlangen, all of Fed. Rep. of Germany

[73] Assignee: Kraftwerk Union Aktiengesellschaft, Mülheim/Ruhr, Fed. Rep. of Germany

[21] Appl. No.: 866,051

[22] Filed: May 21, 1986

[30] Foreign Application Priority Data

May 23, 1985 [DE] Fed. Rep. of Germany ..... 3518628
Dec. 18, 1985 [DE] Fed. Rep. of Germany ..... 3544887

[51] Int. Cl.[4] ..... F23C 11/02

[52] U.S. Cl. ..... 122/4 D; 110/206; 110/245; 110/263

[58] Field of Search ..... 110/245, 263, 264, 204–206, 110/303; 122/4 D; 431/7, 170, 173; 165/104.16; 60/39; 34/57 A; 432/15, 58

[56] References Cited

U.S. PATENT DOCUMENTS

| | | | |
|---|---|---|---|
| 4,060,041 | 11/1977 | Sowards . | |
| 4,295,817 | 10/1981 | Caplin et al. | 431/7 |
| 4,337,032 | 6/1982 | Duplouy et al. | 110/264 X |
| 4,436,037 | 3/1984 | Kuo | 110/245 |
| 4,446,629 | 5/1984 | Stewart et al. | 122/4 D X |
| 4,457,289 | 7/1984 | Korenberg | 431/170 X |
| 4,475,472 | 10/1984 | Adrian et al. | 110/264 X |

FOREIGN PATENT DOCUMENTS

| | | | |
|---|---|---|---|
| 0082673 | 6/1983 | European Pat. Off. . | |
| 2753173 | 6/1978 | Fed. Rep. of Germany . | |
| 2819996 | 11/1978 | Fed. Rep. of Germany . | |
| 6307 | 1/1963 | Japan | 110/206 |
| 1183355 | 3/1970 | United Kingdom . | |
| 2034448 | 6/1980 | United Kingdom | 122/4 D |
| 2121311 | 12/1983 | United Kingdom . | |

OTHER PUBLICATIONS

"Design and Disposition of the Heating Plant of the Municipal Works Duisburg, AG with Circulating Fluidized-Bed Furnace", W. Wein, VGB-Kraftwerkstechnik, 08-1983.

Patents Abstracts of Japan, vol. 8, No. 154, Jul. 18, 1984.

Patents Abstracts of Japan, vol. 4, No. 111, Aug. 9, 1980.

*Primary Examiner*—Steven E. Warner

*Attorney, Agent, or Firm*—Herbert L. Lerner; Laurence A. Greenberg

[57] ABSTRACT

A combustion chamber with a fluidized bed furnace having a nozzle plate, a fuel feed above the nozzle plate, a primary air feed below the nozzle plate, an exhaust gas channel at an upper end of the combustion chamber, and heat-exchanging heating surfaces includes a cylindrical combustion chamber wall disposed vertically upright and having, in an upper region thereof, a plurality of secondary air nozzles disposed tangentially as well as downwardly inclined to the cylindrical wall for separating and returning unspent solid particles into a lower region of the fluidized bed, a device for directing a flow of gas and particles vertically upwardly in a central region of the combustion chamber and spirally downwardly along the cylindrical wall, and a device for impressing an upwardly increasing rotary flow about an axis of symmetry of the combustion chamber upon the gas flow.

20 Claims, 6 Drawing Sheets

111
112
112
112

121
130
119
131
123
122
112
120
IIIA
IIIA 114
116
115
129
117
128
III
125
127
121
130
119
118
113
132
131
111
112
133
120
124
126
III
110

COMBUSTION CHAMBER FOR A FLUIDIZED-BED FURNACE

The invention relates to a combustion chamber with a fluidized-bed furnace having a nozzle plate or sheet or tuyère bottom, a fuel feed above the nozzle plate, a primary air feed below the nozzle plate, an exhaust gas channel at an upper end of the combustion chamber, as well as heat exchanging heating surfaces.

Stationary fluidized-bed furnaces wherein air and gas velocity, respectively, are selected so that an upper limit becomes set for the fluidized bed, and circulating fluidized-bed furnaces, wherein the air and gas velocity, respectively, are selected so high that a major part of the solid particles is removed upwardly out of the fluidized bed, is separated in cyclones and then returned either directly or via an ash cooler into the fluidized bed have become known heretofore from VGB-Kraftwerkstechnik, No. 8, August 1963, article entitled "Design and Disposition of the Heating Plant 1 of the Municipal Works Duisburg, AG with Circulating Atmospheric Fluidized Bed Furnace" by W. Wein. Fluidized-bed furnaces generally have the advantage that fuel of relatively low quality such as waste can also be burned therein and that desulfurization of flue gases by the addition of lime can be accomplished during the combustion in the fluidized bed.

In addition, less $NO_x$ is produced at a lower combustion temperature in fluidized-bed furnaces than in powdered-coal furnaces. However, a circulating fluidized-bed furnace has the further advantage that, due to the circulation of solids, a longer dwelling time of the fuels and additives is achieved, which has a positive effect on the combustion and the desulfurization. Because of the more complete conversion, a lower calcium-to-sulfur ratio is sufficient for the same degree of desulfurization. On the other hand, the circulating fluidized-bed furnace has the disadvantage over the stationary fluidized-bed furnace in that the amount of equipment required is much greater Thus, several additional cyclone stages are required for separating the solid particles which are entrained with and to be returned by the exhaust gas and, furthermore, an ash cooler for maintaining the temperature in the fluidized bed.

It is accordingly an object of the invention to provide a combustion chamber for a fluidized-bed furnace wherein the outlay for equipment is considerably reduced when compared to the outlay for conventional equipment for a circulating fluidized-bed furnace. This reduction in the outlay for equipment should not, however, be at the expense of the $SO_2$ emission, the $NO_x$ reduction and the combustion or burn-up.

With the foregoing and other ojects in view, there is provided, in accordance with the invention, a combustion chamber with a fluidized bed furnace having a nozzle plate, a fuel feed above the nozzle plate, a primary air feed below the nozzle plate, an exhaust gas channel at an upper end of the combustion chamber, and heat-exchanging heating surfaces, comprising a cylindrical combustion chamber wall disposed vertically upright and having, in an upper region thereof, a plurality of secondary air nozzles disposed tangentially as well as downwardly inclined to the cylindrical wall for separating and returning unspent solid particles into a lower region of the fluidized bed, means for directing a flow of gas and particles vertically upwardly in a central region of the combustion chamber and spirally downwardly along the cylindrical wall, and means for impressing an upwardly increasing rotary flow about an axis of symmetry of the combustion chamber upon the gas flow.

In accordance with another feature of the invention, there is provided a cylindrical body fastened to the nozzle plate coaxially to the axis of symmetry of the combustion chamber.

In accordance with an additional feature of the invention, the cylindrical body is constructed as a hollow member In accordance with an added feature of the invention, there is provided an air feed channel connected to the cylindrical body for aiding the rotary flow of the fluidized layer about the axis of symmetry of the combustion chamber, and a plurality of air nozzles carried at an upper end of the cylindrical body and directed approximately tangentially to the circumference of the cylindrical body.

In accordance with again another feature of the invention, the air nozzles of the cylindrical body simultaneously extend upwardly inclined in blowing direction.

In accordance with again an additional feature of the invention, the cylindrical body has a length which is at least one third the height of the combustion chamber.

In accordance with again an added feature of the invention, the the cylindrical body is formed with a cylindrical wall, and including heat exchanger heating surfaces carried by the symmetrical wall.

In accordance with again a further feature of the invention, the cylindrical body is connected to a primary air channel.

In accordance with yet another feature of the invention, there are provided air nozzles in the nozzle plate inclined with respect to the axis of symmetry of the combustion chamber in the same sense as the tangential disposition of the secondary air nozzles.

In accordance with yet an additinal feature of the invention, there is provided an air nozzle for deflecting the fuel particles rising in vicinity of the axis of symmetry of the combustion chamber, the air nozzle being arranged and directed in a manner that the air flow thereof traverses the axis of symmetry of the combustion chamber in a region of medium height thereof.

In accordance with yet an added feature of the invention, there are provided intermediate lines connecting the secondary air nozzles both to the exhaust gas channel as well as to a fresh air line, and adjusting members connected in the intermediate lines for adjusting a mixing ratio of fresh air and exhaust air.

In accordance with yet a further feature of the invention, nozzles of the nozzle plate are connected to a fresh air line.

In accordance with still another feature of the invention, there is provided intermediate lines connecting nozzles of the nozzle plate both to the exhaust gas channel as well as to a fresh air line, and adjusting members connected in and intermediate lines for adjusting a mixing ratio of fresh air and exhaust air.

In accordance with still an added feature of the invention, an annular orifice is inserted between the nozzle plate and the exhaust gas channel, heat exchanger heating surfaces are located on the combustion chamber wall, the secondary air nozzles are disposed between the annular orifice and the exhaust gas channel for producing a secondary air hose flowing downwardly along the combustion chamber wall, and means for defining slot-shaped openings between the annular orifice and the combustion chamber wall for the purpose of internally returning solids.

In accordance with still a further feature of the invention, the secondary air nozzles are disposed in a ring-shaped manner at an upper calotte of the combustion chamber.

In accordance with again an additional feature of the invention, the secondary air nozzles are arranged at the bottom of an annular chamber supplied with secondary air and surrounding in a ring-shaped manner the exhaust gas channel arranged in the upper calotte.

In accordance with again an added feature of the invention, there is provided inclined guide baffles provided with the secondary air nozzles.

In accordance with again a further feature of the invention, the secondary air nozzles have an outward blowing direction tangential to the cylindrical combustion chamber wall and simultaneously downwardly inclined.

In accordance with still an additional feature of the invention, the annular orifice carries twisting nozzles terminating tangentially in an opening formed in the interior of the orifice.

In accordance with still an added feature of the invention, the annular orifice is constructed as an annular chamber connected to at least one secondary-air line and carries at an inner wall thereof tangentially disposed twisting nozzles.

In accordance with still another feature of the invention, there is provided at least one gas compressor preceding the secondary air nozzles.

In accordance with still a further feature of the invention, the annular orifice has an upper side inclined in a funnel-shaped manner to the slot-shaped openings.

In accordance with yet an added feature of the invention, the thus funnel-shaped openings completely surround the entire annular orifice except for relatively narrow bridges. In accordance with yet an additional feature of the invention, there is provided a cylindrical shell suspended below the annular orifice almost down to the nozzle plate, the cylindrical shell having an outer diameter smaller than a diameter determined by inner walls of the slot-shaped openings.

In accordance with yet a further feature of the invention, there are provided heat exchanger tubes welded to the combustion chamber wall for cooling the wall.

In accordance with still another feature of the invention, the combustion chamber wall is constructed as a finned tube wall.

In accordance with still an additional feature of the invention, the heating surfaces are arranged so as to protrude into the space above the annular orifice.

In accordance with still an added feature of the invention, the heating surfaces are arranged so as to protrude into the fluidized bed below the annular orifice.

In accordance with again another feature of the invention, heat exchanging heating surfaces are received in an annular space defined by and between the cylindrical shell and the cylindrical combustion chamber wall.

In accordance with again a further feature of the invention, the cylindrical shell narrows down the fluidized bed as part of the annular orifice, also in a region below the annular orifice, to a cross section which is smaller than the cross section of the cylindrical combustion chamber wall.

In accordance with again an additional feature of the invention, there are provided heat exchanger tubes engaging the cylindrical shell for cooling the shell.

In accordance with again a further feature of the invention, the fuel feed extends through the combustion chamber wall and the cylindrical shell.

In accordance with again an added feature of the invention, the fuel feed extends through the bottom of the combustion chamber.

In accordance with still another feature of the invention, the chamber has a cylindrical cross section above the annular orifice.

In accordance with a concomitant feature of the invention, the chamber has a polygonal cross section below the annular orifice.

According to the invention, entrained solid particles are removed in radial direction from the rising fluidized layer by a strong rotary-flow component of the fluidized layer about the axis of symmetry of the combustion chamber because of the cylindrical cross section of the combustion chamber, which offers little resistance to the rotary flow, and the secondary air nozzles which terminate at the upper half of the combustion chamber wall tangentially to the outer periphery of the cylindrical combustion chamber, and simultaneously generate a downwardly directed peripheral flow. The centrifugally ejected solid particles are transported along the inner wall surface of the combustion chamber back into the lower region of the combustion chamber. It is a particular advantage of this construction, that lighter, largely burned-up solid particles are introduced into the central fluidized bed in the boundary region of the downwardly directed peripheral flow and the rising fluidized layer sooner than heavy solid particles which can be returned to the nozzle plate.

An especially advantageous construction is obtained by centrally fastening a cylindrical body to the nozzle plate. Such a cylindrical body which is arranged coaxially with the symmetry axis of the combustion chamber and the fluidized bed prevents the particles from flowing radially to the center in the lower region of the fluidized bed. This is important because only a small centrifugal-force component is active in the center of the fluidized bed along the symmetry axis of the combustion chamber and, therefore, particles rising along the symmetry axis of the combustion chamber could escape with the exhaust gas through the exhaust gas channel. This construction is also the basis for the further embodiment of the invention.

If a cylindrical body centrally placed upon the nozzle plate is used, it may be realized as a hollow body and may be connected to an air supply channel and to primary air, respectively, and can support, at its upper end, air nozzles directed approximately tangentially to the circumference thereof and with an upward inclination. It is possible, thereby, to transfer in the center of the circulating fluidized layer not only fresh air but additional torques or rotary pulses and to thereby improve the separation of the incompletely burned solid particles and additives, respectively, from the exhaust gas of the combustion chamber.

If an annular orifice is used, it narrows down the fluidized bed in the upper region of the combustion chamber, so that this fluidized bed is separated from the wall of the combustion chamber and, between the wall of the combustion chamber and the narrowed fluidized bed, an annular return flow space surrounding the bed is formed through which entrained particles can be returned into the lower region of the fluidizer bed. In order to aid this return and to ensure simultaneously further after-burning, secondary air is admitted through nozzles above the annular orifice. Due to the fact that slot-shaped openings are provided between the annular orifice and the vessel wall, the returned particles can be transported all the way to the lower region of the fluidized bed.

One advantageous embodiment of the invention is obtained when the secondary air nozzles are arranged in a ring-shaped manner at the upper spherical segment or calotte of the combustion chamber. The secondary air can then blow from there directly downwardly along the wall of the combustion chamber. The wall of the combustion chamber can be formed without any significant breaks therein. The downwardly flowing, somewhat cooler secondary air also simultaneously reduces the thermal stressing or loading of the combustion chamber wall. It may be advisable, in this regard, to arrange the secondary air nozzles at the bottom of a chamber annularly surrounding the exhaust air channel and supplied with secondary air. It is advantageous to arrange over the entire bottom of this last-mentioned chamber, guiding nozzles set at an inclination to the chamber bottom, and through which the secondary air can blow down uniformly and spirally.

The torque which is transmissible to the fluidized bed can be amplified effectively if the annular orifice, in an advantageous further embodiment of the invention, carries secondary air nozzles which terminate tangentially in the inner opening of the annular orifice. In this connection, the annular orifice can also be cooled simultaneously by the secondary air.

Other features which are considered as characteristic for the invention are set forth in the appended claims.

Although the invention is illustrated and described herein as embodied in combustion chamber for a fluidized-bed furnace, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

Figure 1:
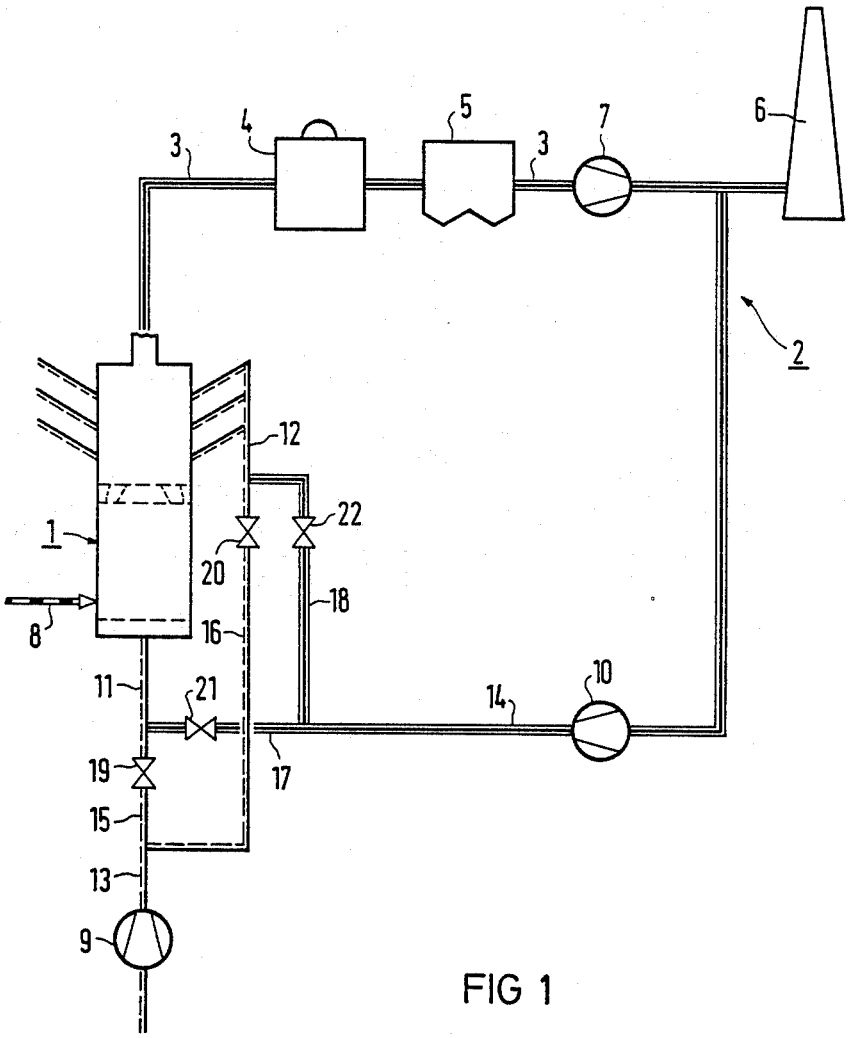
FIG. 1 shows a diagrammatic and schematic circuit arrangement for transporting matter to and from the combustion chamber according to the invention having a fluidized-bed furnace and internal ash return.

Referring now to the drawing and first, particularly, to FIG. 1 thereof, there is shown schematically an arrangement of a combustion chamber 1 according to the invention having a fluidized-bed furnace, and connected in an energy conversion system 2. It is apparent in this view that the hot exhaust gases leaving the combustion chamber 1 are conducted via an exhaust gas channel 3 to a heat exchanger system 4 for generating steam, and subsequently to a filter system 5 for removing dust. Between the filter system 5 and a flue 6 of the combustion chamber 1, a suction draft blower 7 is inserted into the exhaust gas channel 3 in the illustrated embodiment of FIG. 1.

The combustion chamber 1 is supplied, via a fuel feed channel 8, with fuel to which lime has been admixed. In addition, fresh air is fed via an air compressor 9 to flue gas which is cooled by a flue gas compressor 10 and, in the embodiment of FIG. 1, is taken or tapped from the exhaust gas channel 3 leading to the flue 6. The various air feeding lines 11, 12 are connected to the fresh air line 13 as well as to the flue gas line 14. For independently adjusting or setting the mixing ratio of fresh air and flue gas in the two air feed lines 11 and 12, throttle valves 19, 20, 21 and 22 are connected into the branches 15 and 16 of the feed line 13 for the fresh air and into the branches 17 and 18 of the feed line 14 for the flue gas.

Figures 2, 3, 3A:
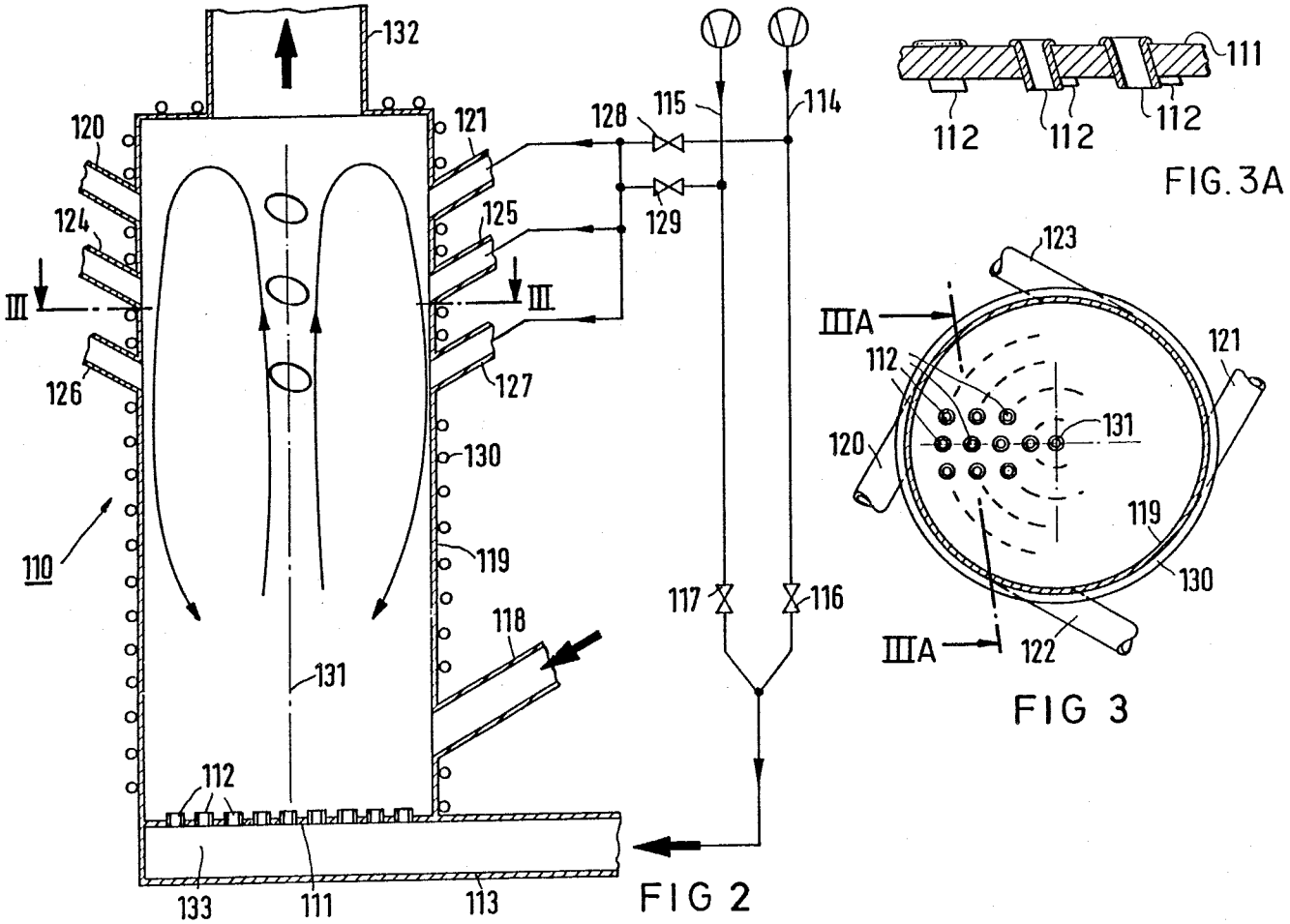
FIG. 2 is a fragmentary, enlarged longitudinal sectional view of combustion chamber according to the invention.
FIG. 3 is a cross-sectional view of FIG. 2 taken along the line III—III.

In FIG. 2 a combustion chamber 110 according to the invention is shown in a longitudinal sectional view. The combustion chamber has a cylindrical cross section. It is terminated at the lower end thereof by a nozzle plate or sheet 111. Air nozzles 112 are inserted at a constant spacing into the nozzle plate 111. An air feeding line 113 terminates in the space below the nozzle plate 111. This line 113 is connected to a fresh-air line 114 as well as to a flue gas line 115. A predetermined fresh-air/flue gas mixture can be set by setting or adjusting devices 116 and 117 installed in both lines 114 and 115. A fuel feeding line 118 terminates in the combustion chamber wall 119 directly above the nozzle plate 111. In the upper third of the combustion chamber, secondary air nozzles 120 to 127 which are arranged at the wall periphery 119, offset 90° relative to one another terminate in different planes in the combustion chamber wall. As shown in FIG. 2, these secondary air nozzles 120 to 127 open into the combustion chamber tangentially and slightly inclined downwardly. Also, these secondary-air nozzles 120 to 127 are connected, like the air feed line 113 to the nozzle plate 111, both to the fresh-air line 114 as well as to the flue gas line 115. Also, in this case, setting or adjusting devices 128 and 129 are provided in the connecting or intermediate lines for adjusting the fresh-air/flue gas mixture. Heat exchanger pipes 130 are attached to the combustion chamber and are connected to a steam circulatory loop, which is not otherwise shown in detail.

During the operation of the combustion chamber 110, a fresh-air/flue gas mixture is blown, as so-called primary air via the air feeding line 113 connected to the fresh air and flue gas line, into the space 133 under the nozzle plate 111. This fresh-air/flue gas mixture can be adjusted on demand by the setting devices 116 and 117 inserted into the fresh-air line 114 and the flue gas line 115. This primary air flowing-in through the air feeding line 113 blows through the air nozzles 112 of the nozzle plate 111 upwardly into the combustion chamber and, accordingly, whirls up the fuel and lime particles fed-in via the fuel and lime feeding channel 118. These fuel particles are entrained upwardly by the rising primary air, are swirled up and partially burned with the oxygen component of the primary air at the prevailing temperature.

By disposing the air nozzles 112 at an inclination in the nozzle plate 111, a rotary motion about the symmetry axis 131 of the combustion chamber is imparted to the fluidized bed in addition to the vertical movement thereof. The secondary air blowing from the secondary-air nozzles inclined tangentially downwardly ensures residual burn-up and transports the radially outwardly borne fuel particles spirally downwardly along the outer wall of the combustion chamber and permits it, mixed with the fuels and additive materials freshly flowing in from the fuel feeding channel 118, to flow back above the nozzle plate 111 onto the fluidized bed. At the same time, this secondary-air hose circulating along the outside wall transmits a torque pulse to the upper part of the fluidized bed which forces the solid particles there gradually outwardly due to centrifugal force. The latter are finally transported into the vicinity of the combustion chamber wall 119 and into the secondary air stream which flows down spirally. The generated flue gas which is laden with light ash particles is removed centrally upwardly from the combustion chamber via the exhaust gas channel 132. To ensure that incompletely burned solid particles can rise along the symmetry axis 131 of the combustion chamber i.e. in regions wherein the centrifugal force is small, and can be entrained into the exhaust-gas channel, an otherwise non-illustrated nozzle can be aligned or oriented so that its air stream or jet blows through the symmetry axis 131 of the combustion chamber. The solid particles rising from these regions can thereby be transported into the outer region of the fluidized bed and thereby seized fully by the rotary flow.

Figure 4:
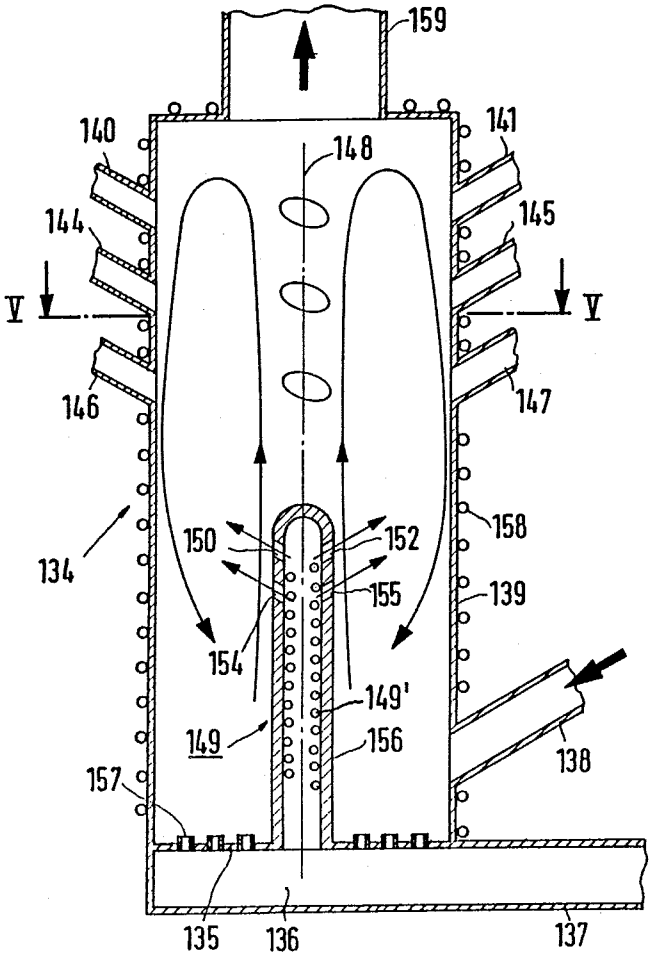
FIG. 4 is a view like that of FIG. 2 of another embodiment of the combustion chamber according to the invention, having a cylindrical body mounted on the nozzle plate.

FIG. 4 shows another embodiment of a combustion chamber 134. Here too, a nozzle plate 135 is located in the lower portion of the combustion chamber and an air feed line 137 opens into the space below the nozzle plate 135. Above the nozzle plate 135, a fuel feeding channel 138 terminates in the wall 139 of the combustion chamber 134. In the upper third of the combustion chamber secondary air nozzles 140 to 147 are arranged in different planes and are directed tangentially to and slightly downwardly of the combustion chamber wall 139. In alignment with the symmetry axis 148 of the combustion chamber 134, a hollow-cylindrical body 149 which protrudes nearly to the center of the combustion chamber 134 is attached to the nozzle plate 135. The hollow space of this hollow-cylindrical body is connected to the space 136 underneath the nozzle plate 135 and thereby also to the air feeding line 137. It is closed at its upper end. Immediately below the upper end of the hollow space, however, holes 150 to 155 are formed at the circumference thereof, which are directed substantially tangentially to the outer wall 156 of the hollow-cylindrical body 149 and inclined upwardly. The arrangement of the secondary air nozzles 140 to 147 in the combustion chamber wall and of the holes 150 to 155 in the hollow-cylindrical body 149 is also apparent from FIG. 4.

The combustion chamber wall 139 supports heat exchanger tubes 158 which are part of a steam loop which is not otherwise shown in detail. Also, the hollow cylindrical body 149 can be provided on the inside thereof with heat exchanger tubes 149' by which it is cooled, and which are connected to a steam loop which is not otherwise shown in detail.

Figure 5:
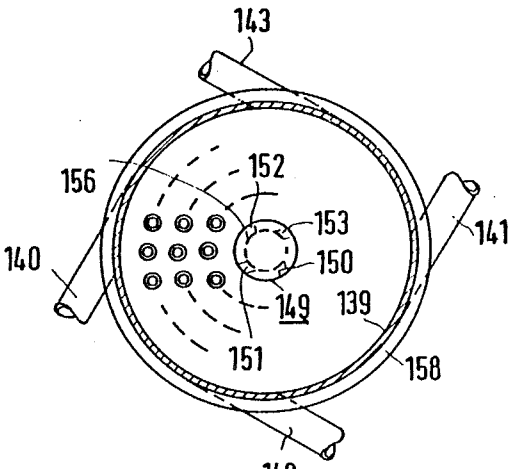
FIG. 5 is a cross-sectional view of FIG. 4 taken along the line V—V.

Similarly to the operation of the combustion chamber 110 of FIGS. 2 and 3, fuel particles are fed into the combustion chamber 134 of FIGS. 4 and 5 through the fuel feeding channel 138, are swirled by the primary air blown out of the air nozzles 157 of the nozzle plate 135 and are burned partially with the oxygen of the primary air at the temperatures prevailing thereat. The residue or remainder is burned-up with the secondary air. In the vicinity of the holes 150 to 155 at the upper end of the hollow cylindrical body 149, additional primary air is not only fed into the central fluidized-bed region, but additionally, a torque pulse about the symmetry axis 148 of the combustion chamber 134 is imparted to the fluidized bed due to the in-flow direction thereof. This torque pulse is further amplified by the secondary air nozzles 140 to 147 terminating tangentially in the combustion chamber and the secondary air flowing-in therethrough. Due to this torque pulse about the symmetry axis of the combustion chamber, the heavier as yet incompletely burned-up particles are driven, as in the embodiment of FIGS. 1 and 2, gradually to the outside and into the vicinity of the secondary air which flows downwardly there in helical or spiral fashion. Together with the fuel particles flowing-in via the fuel feed canal 138, they are transported with the secondary air back into the lower part of the fluidized bed. In addition, the hollow cylindrical body 149 also prevents fuel particles from rising along the symmetry axis of the combustion chamber so that they do not get into the rotary downward flow. The amplified torque pulse transmission to the fluidized bed in the upper region of the combustion chamber 134 due to the primary air escaping at the upper end of the hollow cylindrical body 149, also due to the absence of fluidized bed regions rising centrically to the symmetry axis, leads to improved separation of fuel particles from the combustion gases which are either incompletely burned or not burned at all.

Figure 6:
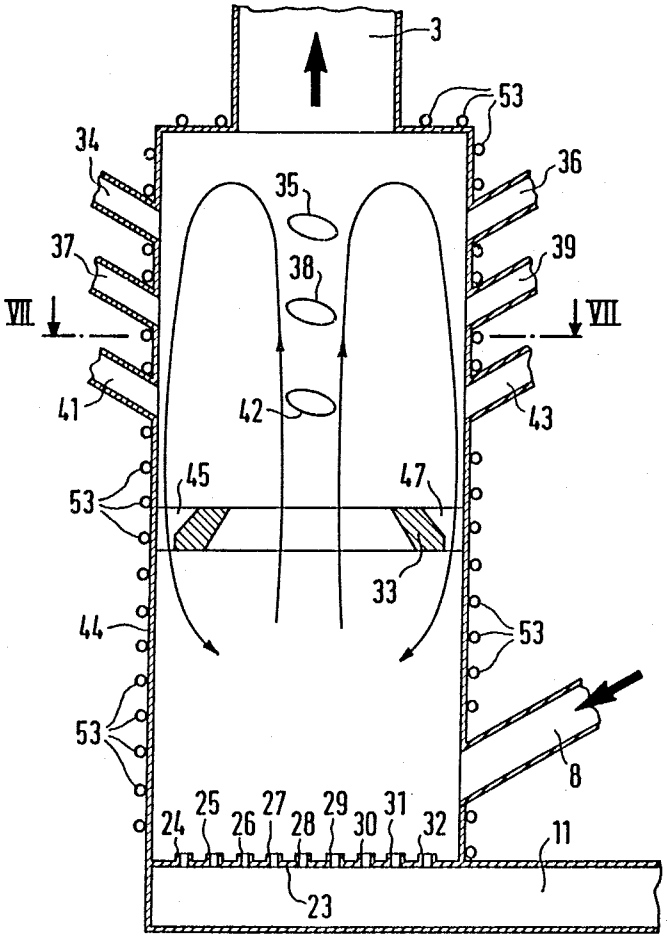
FIG. 6 is a view like that of FIG. 2 of the combustion chamber of FIG. 1 according to the invention.

FIG. 6 is an enlarged longitudinal sectional view of the combustion chamber 1 of FIG. 1. The combustion chamber has a cylindrical cross section with a nozzle plate 23 arranged in a lower region thereof. Air nozzles 24 to 32 are introduced into the nozzle plate 23 at constant mutual spacing. An air feed line 11 which is connected to a fresh-air line 13 as well as to a flue gas line 14 terminates at and underneath the nozzle plate 23.

Figure 7:
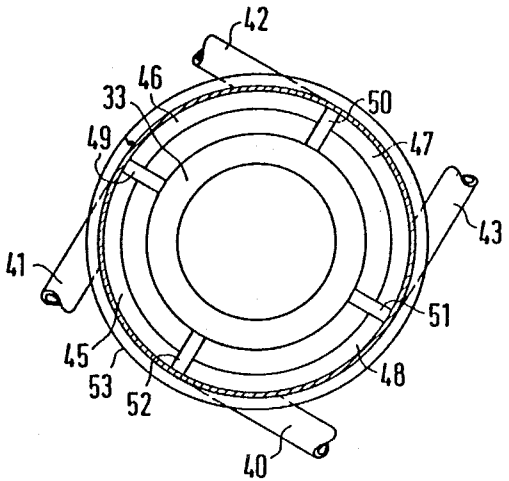
FIG. 7 is a cross-sectional view of FIG. 6 taken along the line VII—VII.

The combustion chamber 1 is subdivided by an orifice 33. The upper spherical end or calotte of the combustion chamber is connected to an exhaust gas channel 3. A fuel feed channel 8 is introduced into the outside wall of the combustion chamber underneath the annular orifice 33 and above the nozzle plate 23. Above the annular orifice 33 four secondary air nozzles 34 to 43, respectively, arranged offset by 90° from one another, are inserted into the outside wall 42 of the combustion chamber in three different planes, in the embodiment of FIG. 6. As shown in the cross-sectional view of FIG. 7, these secondary air nozzles 34 to 43 are arranged tangentially to the outside wall 42 of the combustion chamber 1. In addition, they are set at an angle to the horizontal, as clearly is shown in FIG. 6, so that the inflowing secondary air is given a twist and flows downwardly in helical or spiral fashion along the outside wall of the combustion chamber. As is shown in FIG. 1, these secondary air nozzles are connected to the fresh-air line 13 as well as to the flue gas line 14. In the vicinity of the outside wall 44 of the combustion chamber 1, the annular orifice is formed with narrow slots 45, 46, 47, 48 which extend over nearly the entire circumference of the outside wall 44 of the combustion chamber, being mutually separated only by narrow strips or bridges 49, 50, 51, 52 at which the annular orifice is supported. To the outside wall of the combustion chamber are welded heat exchanger tubes 53 which are connected to a water-steam loop.

In the operation of the combustion chamber, a fresh-air/flue gas mixture, the so-called primary air, flows-in under the nozzle plate 23 via the fresh air and flue gas lines 13 and 14 and the compressors 9 and 10 connected into these lines. The primary air is blown from the air nozzles 24 to 32 of the nozzle plate 23 upwardly and, in the process, swirls the solid particles fed-in via the fuel feed channel 8.

These solid particles are entrained upwardly by the rising primary air, the fuel being burned in the process. In the upper region of the fluidized bed, an annular orifice 33 is provided. By means of this annular orifice 33, space is provided for a downwardly-directed return flow between the fluidized bed and the outside wall 44 of the combustion chamber 1. This return flow is accelerated by the tangential injection of secondary air via the secondary air nozzles 34 to 43, and set into rotation. Via this secondary-air jacket, a torque pulse is also transmitted to the rising fluidized bed and the latter is set in rotation. Thus, the entrained particles are ejected radially from the rising fluidized bed and entrained along the outside wall of the combustion chamber 1 by the spiral downwardly rotating secondary-air enclosure there and drawn downwardly. In the process, these particles are transported via slots 45 to 48 between the annular orifice 33 and the outside wall 44 of the combustion chamber 1 into the fluidized bed located underneath the annular orifice. These particles and flue gases give off heat to the outside wall of the combustion chamber 1 which is cooled by heat exchanger tubes 53.

The secondary air nozzles 34 to 43 are supplied via a branch 16 of the fresh-air line 13 and a branch 18 of the flue gas line with a gas mixture referred to herein as secondary air and which receives a presettable amount of oxygen via the throttling valves 10 and 22 connected into the branches. With this graduated oxygen supply, graduated or stepwise combustion can be achieved which, in the presence of nitrogen fuel effects a reduction in the $NO_x$ emission. In addition, the dwell time of the solid particles is increased by the return thereof. The lime fed-in with the fuel can thereby be reacted more completely with the sulfur, which markedly decreases the sulfur dioxide content of the exhaust gas and the required Ca/S ratio.

Figure 9:
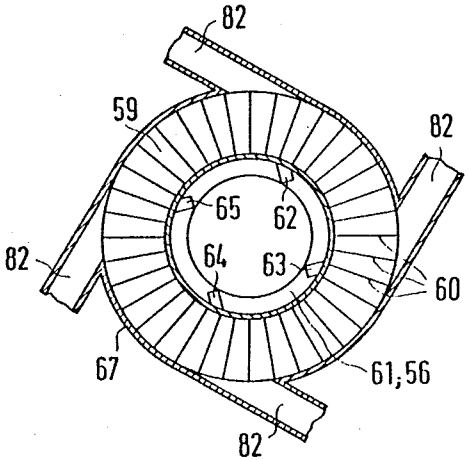
FIG. 9 is a cross-sectional view of FIG. 8 taken along the line V—V of FIG. 8.
Figure 8:
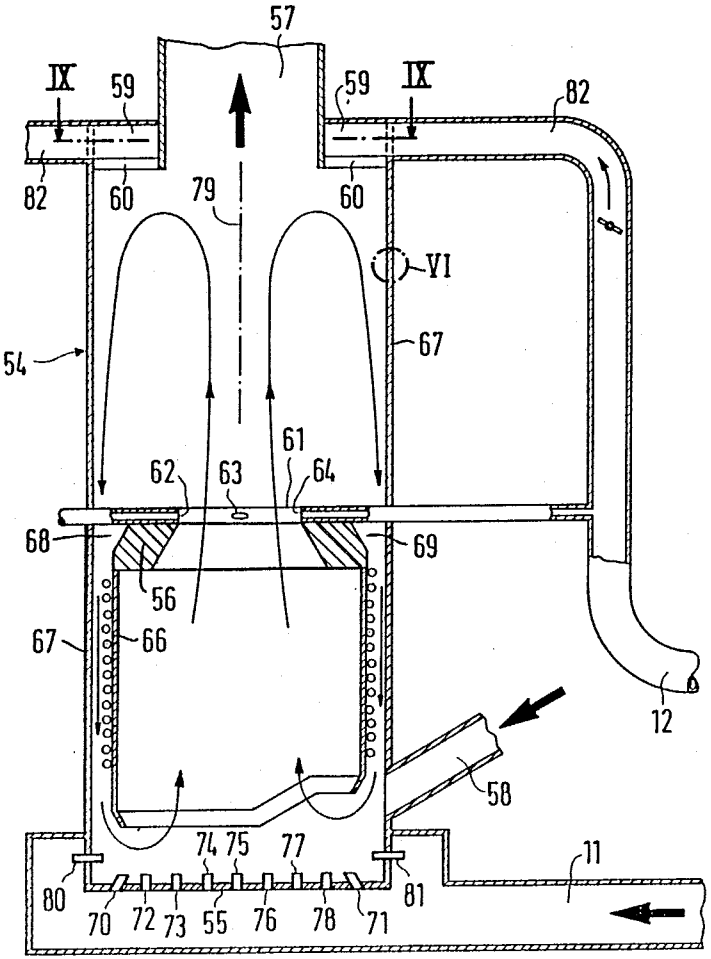
FIG. 8 is a view like that of FIG. 2 of a fourth embodiment of the combustion chamber with a fluidized bed furnace and internal ash return, wherein the air input nozzles are inserted at the bottom of a chamber annularly surrounding the exhaust gas channel.

FIGS. 8 and 9 show a longitudinal and a cross sectional view of another embodiment of the combustion chamber 54 with fluidized-bed furnace which is a further development over the embodiment shown in FIGS. 1 and 6 in some respects. Whereas also in FIGS. 8 and 9, a nozzle plate 55, an annular orifice 56 in the central region of the combustion chamber, a concentric exhaust gas channel 57 at the upper end of the combustion chamber, and a fuel feed channel 58 are provided immediately above the nozzle plate 55, the secondary air deviating from the embodiment of FIGS. 1 and 6, is fed-in via an annular chamber 59 which is arranged at the upper end of the combustion chamber 54 and annularly surrounds the exhaust gas channel 57, the annular chamber 59 being in communication with the interior of the combustion chamber 54 via inclined guiding baffles 60. In this embodiment of FIGS. 8 and 9 the annular orifice 56 carries an extension 61 of the same inside diameter, into which swirling or twisting nozzles 62, 63, 64 and 65 are inserted. Under the annular orifice 56, a cylindrical shell or jacket 66 is fastened in the combustion chamber and extends almost to the nozzle plate 55 having between it and the outside wall 67 of the combustion chamber 54 an annular gap of sufficient width for passing on the particles returned through the slots 68 and 69 (only two of which are visible) into the lower portion of the fluidized bed. This shell 66 is recessed or cut away in the vicinity of the fuel feeding channel 58 to such an extent that it does not impede the fuel supply.

In the nozzle sheet 55, all of the air nozzles 70 and 78 are inclined, in the direction of the torque pulse to be transmitted to the fluidized bed symmetrically to the symmetry axis 79 of the combustion chamber 54, at the same angle to the vertical. In addition, the air nozzles 70 and 71 arranged in the marginal region of the nozzle plate are inwardly inclined. In addition, further substantially radially inwardly blowing air nozzles 80 and 81 are provided directly underneath the opening of the shell 66 which is suspended from the annular orifice. The swirl or twist nozzles 62 to 65 in the annular orifice 56 and the air nozzles 80 and 81 in the combustion chamber wall directly above the nozzle plate are connected to the fresh-air line 13 as well as to the flue gas line 14, as shown in FIG. 1. Via the adjustable throttling valves 19 and 22 which are inserted into the individual branches 15 to 18 of the secondary air lines shown in FIG. 1, the individual groups of nozzles can be addressed differently.

FIG. 9 shows that the individual branches 82 of the secondary-air feed line 12 terminate tangentially in the annular chamber 59. Thereby, a swirl or twist is generated which needs to be deflected only slightly downwardly by the inclined guide baffles 60 arranged at the bottom of the annular chamber. FIG. 9 also shows clearly the opening of the annular orifice 56 located beneath the baffles 60, with the swirl or twist nozzles 62 to 65 which are disposed on the annular orifice and likewise open tangentially into the central opening of the annular orifice.

Figure 10:
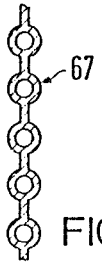
FIG. 10 is an enlarged fragmentary view of FIG. 8 showing part of the outside wall of the combustion chamber.

FIG. 10 shows a magnified detail of the outside wall 67 of the combustion chamber 54 and the shell 66 suspended from the annular orifice 56 The construction of the walls as gastightly welded finned-tube walls may be seen in FIG. 10.

In the operation of the combustion chamber 54, an air-gas mixture with adjustable oxygen content is transported in the air feeding line 11 via the fresh-air compressor 9 and the compressor 10 in the flue gas line 14 and the throttling valves 19 to 22. This air-gas mixture emerges from the air nozzles in the nozzle plate 55 of the combustion chamber and at the lower end of the outside wall and generates an upwardly-directed helical or spiral flow in the combustion chamber. The fuel introduced via the fuel feeding channel 58 and which has been milled and admixed with lime according to its sulfur content, is forced up by this air current, distributed finely and burned-up in the fluidized bed. This fluidized bed is narrowed to a smaller cross section by the annular orifice 56 in the upper part of the combustion chamber 54. The rotary motion of the rising fluidized bed about the symmetry axis 79 of the combustion chamber, which is induced by the inclined air nozzles 70 to 78 at the nozzle plate 55 of the combustion chamber 54, is reinforced above the annular orifice by the secondary air flowing from the tangentially arranged swirl or twist nozzles 62 to 65. This leads to the situation that the individual fine particles are flung radially outwardly from the rising fluidized bed hose, are transported to the vicinity of the wall of the combustion chamber 54 and are entrained by the secondary air which flows downwardly in helical or spiral manner thereat. They are transported through the slots 68, 69 between the outside wall 67 of the combustion chamber 54 and the annular orifice 56 by the secondary air and flow down between the shell 66 and the outside wall 67 of the combustion chamber to a location directly above the bottom of the combustion chamber. There, they are seized by the gas-air mixture emerging from the air nozzles 70 to 78, 80 and 81 and blown upwardly again. In the process, the flue gas which is largely freed of unburned particles, flows through the exhaust gas channel 57 into the heat exchanger 4 connected thereto.

The tube walls of the combustion chamber 54 as well as of the shell 66 may be constructed as finned-tube walls as shown in FIG. 10, and can be used as heating surfaces. It is a great advantage of this construction, that the outside walls 67 of the combustion chamber 54 are, in addition, protected against the direct action of the fluidized bed also by the shell 68 and the cooler secondary air flowing down along the wall. It is a further advantage of this construction, that a longer dwell time of the individual particles of the fluidized bed is obtained by the return of the solids from the upper portion of the combustion chamber 54 into the lower portions of the fluidized bed, whereby the burn-up and the sulfur bonding or fusing into the lime fed-in with the fuel is improved. In this manner, a smaller addition of lime is sufficient for a given sulfur content of the fuel. Because secondary air with a lower oxygen content is fed in, a graduated combustion i.e. combustion with initially reducing atmosphere, can be realized and less $NO_x$ emission is obtained thereby. Also, the cyclone stages and ash coolers which are otherwise required for the circulating fluidized-layer furnace are avoided with this combustion chamber, because the cooling of the ash can be achieved by admixing cooler recirculated-flue gases. In addition, a high degree of separation for solid particles is achieved by the intensive rotary acceleration of the fluidized layer, generated via the swirl nozzles, above the annular orifice, so that no further cyclone stages are required. Also, the heat irradiation losses are greatly reduced in comparison with an installation with circulating fluidized bed combustion, two cyclone stages and an ash cooler and hot pipelines mutually connecting them. Because of the cylindrical shape of the combustion chamber, the latter can also be enabled to operate with a loaded fluidized bed. The finned-tube walls of the combustion chamber can be included without any problem in a steam loop.

Figure 11:
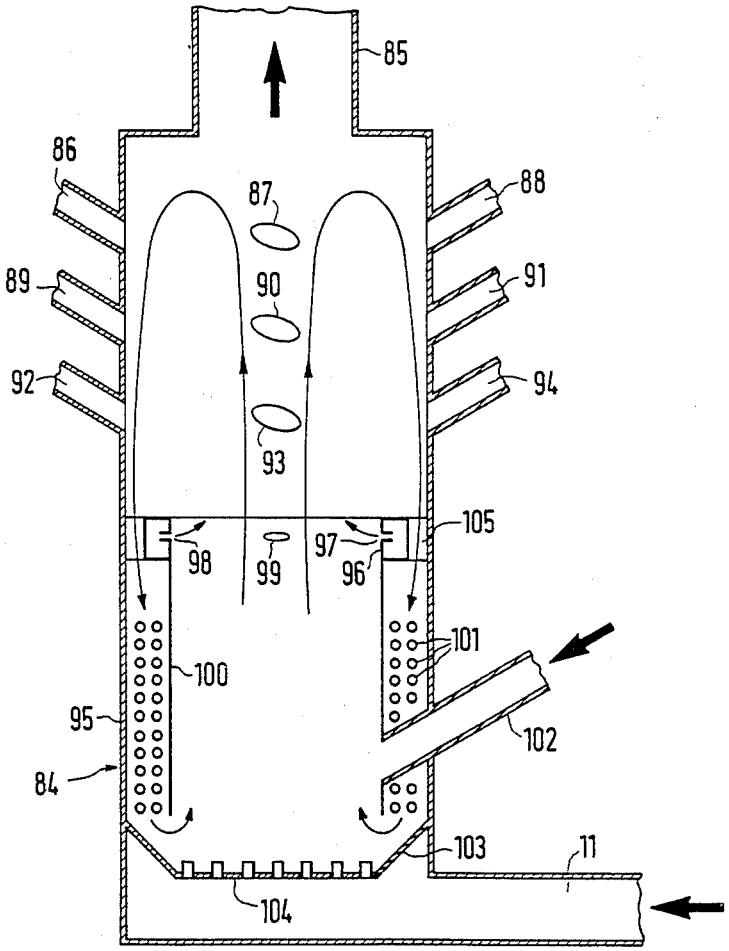
FIG. 11 is a view like that of FIG. 2 of a fifth embodiment of the combustion chamber with a fluidized-bed furnace and internal ash return, wherein cooling surfaces are arranged in the return path of the ash.

FIG. 11 shows a further embodiment of a combustion chamber 84 with fluidized bed combustion. In this combustion chamber 84, the exhaust-gas channel 85 and the secondary air nozzles 86 to 94 are inserted into the outside wall 95 of the combustion chamber exactly in the same manner as described in conjunction with the embodiment of FIGS. 6 and 7. The annular orifice 96, however, is constructed as a ring channel for the secondary air and carries at its inner diameter swirl or twist nozzles 97, 98, 99 (only three being shown) directed tangentially to the inner cross section. The shell 100 arranged under the annular orifice 97 has a diameter reduced to a dimension which corresponds approximately to the inner diameter of the annular orifice 96, when compared with the embodiment of FIGS. 8 and 9. Into the annular gap 105 between this shell 100 and the outside wall 95 of the combustion chamber 84 and the annular orifice 96, heat exchanger tubes 101 for cooling the ash are inserted. The fuel feed channel 102 extends through the shell. The rim 103 of the nozzle plate 104 is beveled or inclined in the form of a funnel as compared to the embodiment of FIGS. 6 to 9.

When compared with the combustion chambers 1, 54 shown in the embodiments of FIGS. 6 to 9, this embodiment of the combustion chamber 84 shown in FIG. 11 has the advantage that, for maintaining the temperature in the fluidized bed layer, less cold flue gas needs to be returned, because heat is removed at the heat exchanger tubes 101 arranged between the shell 100 and the outside wall 95.

We claim:

1. Combustion chamber with a fluidized bed furnace having a nozzle plate, a fuel feed above the nozzle plate, a primary air feed below the nozzle plate, an exhaust gas channel at an upper end of the combusition chamber, and heat-exchanging heating surfaces, comprising a cylindrical combustion chamber wall disposed vertically upright and having, in an upper region thereof, a plurality of secondary air nozzles disposed tangentially as well as downwardly inclined to the cylindrical wall for separating and returning unspent solid particles into a lower region of the fluidized bed, means for directing a flow of gas and particles vertically upwardly in a central region of the combustion chamber and spirally downwardly along the cylindrical wall, and means for impressing an upwardly increasing rotary flow about an axis of symmetry of the combustion chamber upon the gas flow, an annular orifice being inserted between the nozzle plate and the exhaust gas channel, heat exchanger heating surfaces being located on said combustion chamber wall, said secondary air nozzles being disposed between said annular orifice and the exhaust gas channel for producing a secondary air hose flowing downwardly along said combustion chamber wall, and means for defining slot-shaped openings being located between said annular orifice and said combustion chamber wall for the prupose of internally returning solids.

2. Combustion chamber according to claim 1, including inclined guide baffles provided with said secondary air nozzles.

3. Combustion chamber according to claim 1, wherein said secondary air nozzles have an outward blowing direction tangential to said cylindrical combustion chamber wall and simultaneously downwardly inclined.

4. Combustion chamber according to claim 1, wherein the chamber has a cylindrical cross section above said annular orifice.

5. Combustion chamber according to claim 1, wherein the chamber has a polygonal cross section below said annular orifice.

6. Combustion chamber according to claim 1, wherein said secondary air nozzles are disposed in a ring-shaped manner at an upper calotte of the combustion chamber.

7. Combustion chamber according to claim 6, wherein said secondary air nozzles are arranged at the bottom of an annular chamber supplied with secondary air and surrounding in a ring-shaped manner the exhaust gas channel arranged in the upper calotte.

8. Combustion chamber according to claim 1, wherein said annular orifice carries twisting nozzles terminating tangentially in an opening formed in the interior of the orifice.

9. Combustion chamber according to claim 1, wherein said annular orifice is constructed as an annular chamber connected to at least one secondary-air line and carries at an inner wall thereof tangentially disposed twisting nozzles.

10. Combustion chamber according to claim 1, wherein said annular orifice has an upper side inclined in a funnel-shaped manner to said slot-shaped openings.

11. Combustion chamber according to claim 10, wherein the thus funnel-shaped openings completely surround the entire annular orifice except for relatively narrow bridges.

12. Combustion chamber according to claim 11 including a cylindrical shell suspended below the annular orifice almost down to the nozzle plate, said cylindrical shell having an outer diameter smaller than a diameter determined by inner walls of said slot-shaped openings.

13. Combustion chamber according to claim 1, wherein said combustion chamber wall is constructed as a finned tube wall.

14. Combustion chamber according to claim 1, wherein said heating surfaces are arranged so as to protrude into the space above said annular orifice.

15. Combustion chamber according to claim 1, wherein said heating surfaces are arranged so as to protrude into the fluidized bed below said annular orifice.

16. Combustion chamber according to claim 12, wherein heat exchanging heating surfaces are received in an annular space defined by and between said cylindrical shell and said cylindrical combustion chamber wall.

17. Combustion chamber according to claim 12, wherein said cylindrical shell narrows down the fluidized bed as part of said annular orifice, also in a region below said annular orifice, to a cross section which is smaller than the cross section of said cylindrical combustion chamber wall.

18. Combustion chamber according to claim 12, including heat exchanger tubes engaging said cylindrical shell for cooling said shell.

19. Combustion chamber according to claim 12, wherein said fuel feed extends through said combustion chamber wall and said cylindrical shell.

20. Combustion chamber according to claim 12, wherein said fuel feed extends through the bottom of the combustion chamber.

* * * * *